US007610633B2

(12) United States Patent
Zanardelli et al.

(10) Patent No.: US 7,610,633 B2
(45) Date of Patent: Nov. 3, 2009

(54) SECURING BATH SEATS

(75) Inventors: Kevin Zanardelli, Quincy, MA (US); James M. Buckley, New Hartford, CT (US); Bruce P. Popek, South Windsor, CT (US); Craig Bures, Prospect, CT (US); Thomas McDonald, Longmeadow, MA (US)

(73) Assignee: The First Years Inc., Avon, MA (US)

( * ) Notice: Subject to any disclaimer, the term of this patent is extended or adjusted under 35 U.S.C. 154(b) by 0 days.

(21) Appl. No.: 11/879,367

(22) Filed: Jul. 17, 2007

(65) Prior Publication Data

US 2007/0294820 A1 Dec. 27, 2007

Related U.S. Application Data

(63) Continuation of application No. 10/831,878, filed on Apr. 26, 2004, now Pat. No. 7,243,380, which is a continuation-in-part of application No. 10/278,042, filed on Oct. 22, 2002, now Pat. No. 6,834,400.

(51) Int. Cl.
*A47K 3/024* (2006.01)

(52) U.S. Cl. ..... 4/572.1

(58) Field of Classification Search ..... 4/572.1, 4/579

See application file for complete search history.

(56) References Cited

U.S. PATENT DOCUMENTS

| | | | | |
|---|---|---|---|---|
| 337,001 | A | | 3/1886 | Kelley |
| 362,969 | A | | 5/1887 | Jacobus |
| 488,011 | A | | 12/1892 | Keene |
| 602,125 | A | | 4/1898 | Burrows |
| 642,168 | A | | 1/1900 | Smith |
| 1,245,660 | A | | 11/1917 | Behm |
| 1,428,039 | A | | 9/1922 | Kratz |
| 2,113,190 | A | * | 4/1938 | Bentz ..... 4/579 |
| 2,177,998 | A | | 10/1939 | Schuette |
| 3,022,518 | A | | 2/1962 | Hayden |
| 3,289,217 | A | | 12/1966 | Glover |
| 4,472,844 | A | | 9/1984 | Mace |
| 4,837,871 | A | | 6/1989 | Wheeler |
| 5,097,542 | A | | 3/1992 | Roesler |
| 5,158,460 | A | | 10/1992 | Bernstein et al. |
| 5,313,675 | A | | 5/1994 | Tinen |
| 6,112,343 | A | | 9/2000 | Dixon |
| RE37,346 | E | | 9/2001 | Frawley et al. |
| 6,314,592 | B1 | | 11/2001 | Stein |
| 7,058,995 | B2 | | 6/2006 | Sundberg et al. |

* cited by examiner

*Primary Examiner*—Tuan N Nguyen
(74) *Attorney, Agent, or Firm*—Michael Best & Friedrich LLP

(57) ABSTRACT

A child bath seat, adapted for use with a bathtub, includes a seat body that includes both a seat and a retaining structure extending above the seat for laterally retaining a child seated in the seat body. The seat also includes a bracing structure that holds the seat body in an upright position. The bracing structure has a first end attached to the seat body, and a second end, defining a recess, for receiving an upper edge of a side of the bathtub. The seat also includes a foot structure attached to the bracing structure and capable of being placed in contact with a predominantly horizontal surface outside the bathtub. The child bath seat can be adjustable to accommodate varying bathtub side widths and varying bathtub depths and can be suspended above or a portion of the bath seat can rest on the bottom surface of the bathtub.

17 Claims, 9 Drawing Sheets

SECURING BATH SEATS

RELATED APPLICATIONS

This application is a continuation of U.S. patent application Ser. No. 10/831,878, filed on Apr. 26, 2004, now U.S. Pat. No. 7,243,380, issued on Jul. 17, 2007, which is a continuation-in-part of U.S. patent application Ser. No. 10/278,042, filed on Oct. 22, 2002, now U.S. Pat. No. 6,834,400, issued on Dec. 28, 2004. The contents of these applications are incorporated herein by reference.

BACKGROUND

The invention relates to child bath seats, such as are used for bathing children. Children are often placed in a bath seat for support during bathing in a bathtub. Often the bathtub is filled with about an inch of water and the adult uses a sponge or a face cloth to bathe the child while the child sits secured in the child bath seat. Concerns have been raised about the safety of child bath seats, particularly when parents improperly leave the child alone in the bathtub. Improvements are sought in the safety and convenience of bath seats in general

SUMMARY

An aspect of the invention features a child bath seat, placed within and attached to a bathtub. The child bath seat includes a seat body that includes both a seat and a retaining structure extending above the seat for laterally retaining a child seated in the seat body. The seat also includes a bracing structure that holds the seat body in an upright position. The bracing structure has a first end attached to the seat body, and a receiving portion, defining a recess, for receiving an upper edge of a side of the bathtub.

Various embodiments have one or more of the following features. For example, the child bath seat may include a clamping mechanism that secures the receiving portion of the bracing structure to the side of the bathtub. Also, the bracing structure may include a horizontal adjustment bracket that allows adjustment of the bracing structure, which corresponds to a width of the side of the bathtub. In addition, the bracing structure may include a vertical adjustment bracket to adjust a vertical position of the seat relative to a bottom surface of the bathtub. Similarly, the child bath seat may feature a foot structure attached to a second end of the bracing structure and capable of being placed in contact with a predominantly horizontal surface outside the bathtub. The foot structure may be pivotably attached to the second end of the bracing structure or may comprise a piece of flexible material extendable from the bracing structure to the predominantly horizontal surface outside the bathtub.

Various embodiments of the foot structure have one or more of the following features. The foot structure may include a padded first portion. The foot structure may also include at least one wall and a bottom with the at least one wall being predominantly vertical and the bottom being predominantly horizontal in orientation when the foot structure is pivoted to contact the predominantly horizontal surface outside the bathtub. In these embodiments, the at least one wall may be fixed to the bottom to form a bin defining a cavity. The first portion and the bin may be independently pivotably attached to the bracing structure with the first portion arranged to rest upon the bin so as to enclose the cavity when the first portion and the bin are both pivoted away from the bracing structure. In these embodiments, the bracing structure may include a second vertical adjustment bracket to adjust a second vertical position of the foot structure relative to a bottom surface of the bathtub.

Other embodiments feature a bath seat including a support member attached to a bottom surface of the seat. The bath seat may engage the bottom surface of the bathtub only on a side of the bath seat opposite the bracing structure.

In still other features, the child bath seat, in its upright position and resting on a bottom surface of the bathtub, contacts the bottom surface of the bathtub only on one side of a center gravity of the seat body. Further, the seat body may rest on the bottom surface of the bathtub. Alternatively, the seat body may be suspended over the bottom surface of the bathtub.

An aspect of the invention features a child bath seat placed within and clamped to a bathtub. The child bath seat includes a seat body that includes both a seat and a retaining structure above the seat for laterally retaining a child in the seat body. The child bath seat also includes a bracing structure that holds the seat in an upright position. The bracing structure has a first end attached to the seat body, and a receiving portion that has a clamp secured over an upper edge of the bathtub. A foot structure is attached to a second end of the bracing structure and is capable of being placed in contact with a predominantly horizontal surface outside the bathtub. Various embodiments of this aspect have one or more of the features described above.

An aspect of the invention features a method of securing a bath seat within a bathtub for bathing a child therein. The method includes placing the bath seat into the bathtub. The bath seat includes a seat, a bracing structure, and a foot structure. The seat includes both a seat and retaining structure extending above the seat for laterally retaining a child in the seat body. The bracing structure has a first end attached to the seat body, and a receiving portion defining a recess. The foot structure is attached to a second end of the bracing structure and is capable of being placed in contact with a predominantly horizontal surface outside the bathtub. The method also includes attaching the receiving portion of the bracing structure over an upper edge of a side of the tub, with the upper edge of the side of the tub received in said recess and the seat body in an upright position.

Various embodiments have one or more of the following features. For example, a horizontal adjustment bracket may be adjusted on the bracing structure to correspond to a width of the side of the bathtub. In addition, a first vertical position of the seat may be adjusted relative to a bottom surface of the bathtub. Similarly, a second vertical position of the foot structure may be adjusted relative to the predominantly horizontal surface outside the bathtub. The bath seat may be secured in place by resting a significant portion of an adult's weight upon the foot structure.

In other features, the bottom surface of the bathtub may be engaged only on a side of the bath seat opposite the bracing structure. Further, the bottom surface of the bathtub may be contacted only on one side of a center of gravity of the seat body in its upright position. Alternatively, the seat body may be suspended over the bottom surface of the bathtub.

An aspect of the invention features a method for bathing a child. The method includes placing a child bath seat in a tub. The child bath seat includes a seat body, a bracing structure, and a foot structure. The seat body includes both a seat and retaining structure above the seat for laterally retaining a child in the seat body. The bracing structure has a first end attached to the seat body, and a receiving portion defining a recess for receiving an upper edge of a side of the tub with the seat body placed within the tub to hold the seat body in an upright position. The foot structure is attached to a second end of the bracing structure and is capable of being placed in contact with a predominantly horizontal surface outside the bathtub. The method also includes attaching the receiving portion of the bracing structure over the upper edge of the side of the tub, inserting the child into the seat body, and securing the child within the retaining structure.

Various embodiments of this aspect have one or more of the following features described above.

Various aspects of the invention can provide advantages in the function and convenience of child bath seats. For example, the bracing structure holds the bath seat firmly in place thereby preventing the child seat from tipping over during bathing or when the child is physically active. The bracing structure can also be adjusted to conform to non-standard bathtub side widths. Thus, one bath seat can be used in multiple locations and brought along during travel.

In other advantages, the bath seat can be adjustable to change the relative height of the bath seat to adapt to multiple tubs of varying depths. Thus, the bath seat can be used longer as the child grows in height or for children of different sizes. Further, the bath seat can also be structured to advantageously deter parents from placing children in the seat unless the bath seat is first properly secured in the bathtub.

Other features, objects, and advantages of the invention will be apparent from the description and drawings, and from the claims.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference symbols in the various drawings indicate like elements.

DETAILED DESCRIPTION

Figure 1A:
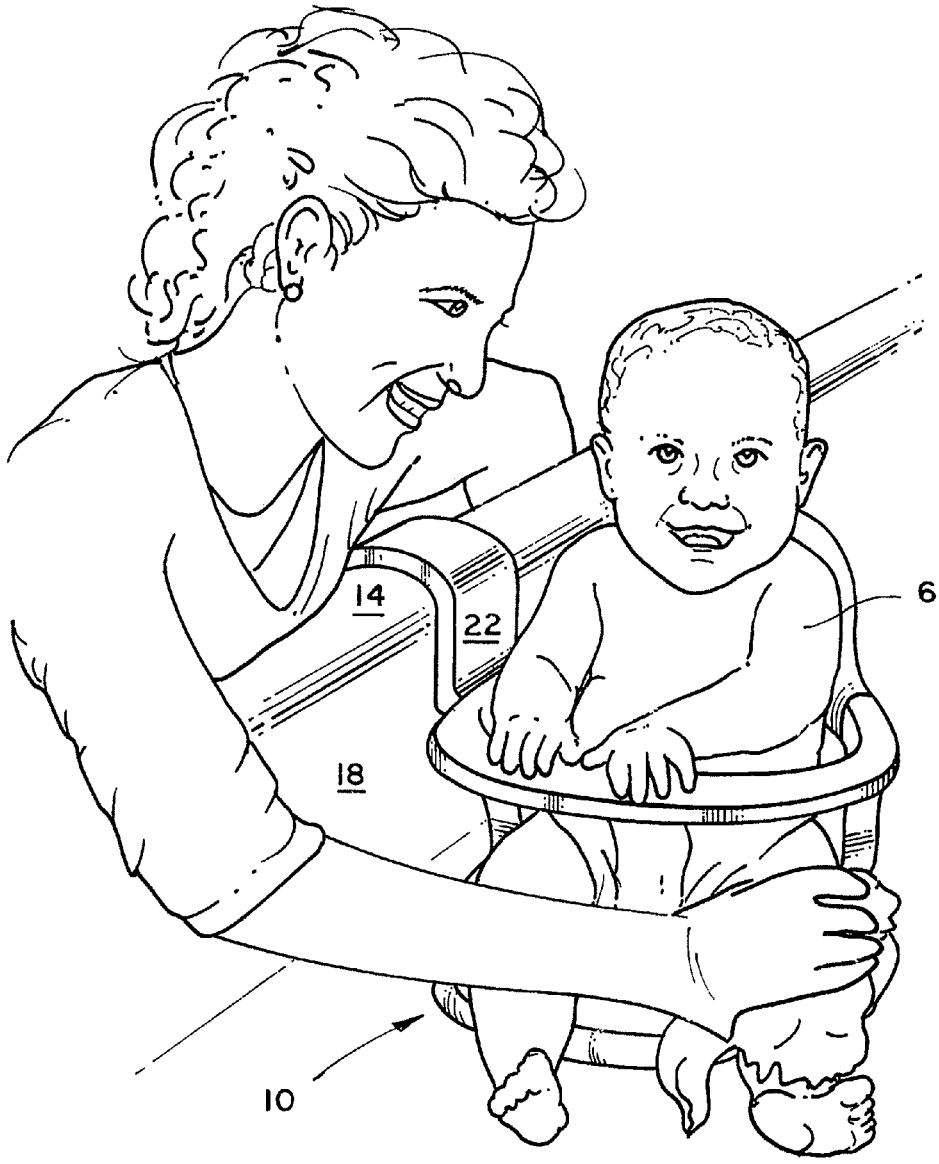
FIG. 1A is a view of a bracing child bath seat with a child.
Figure 1B:
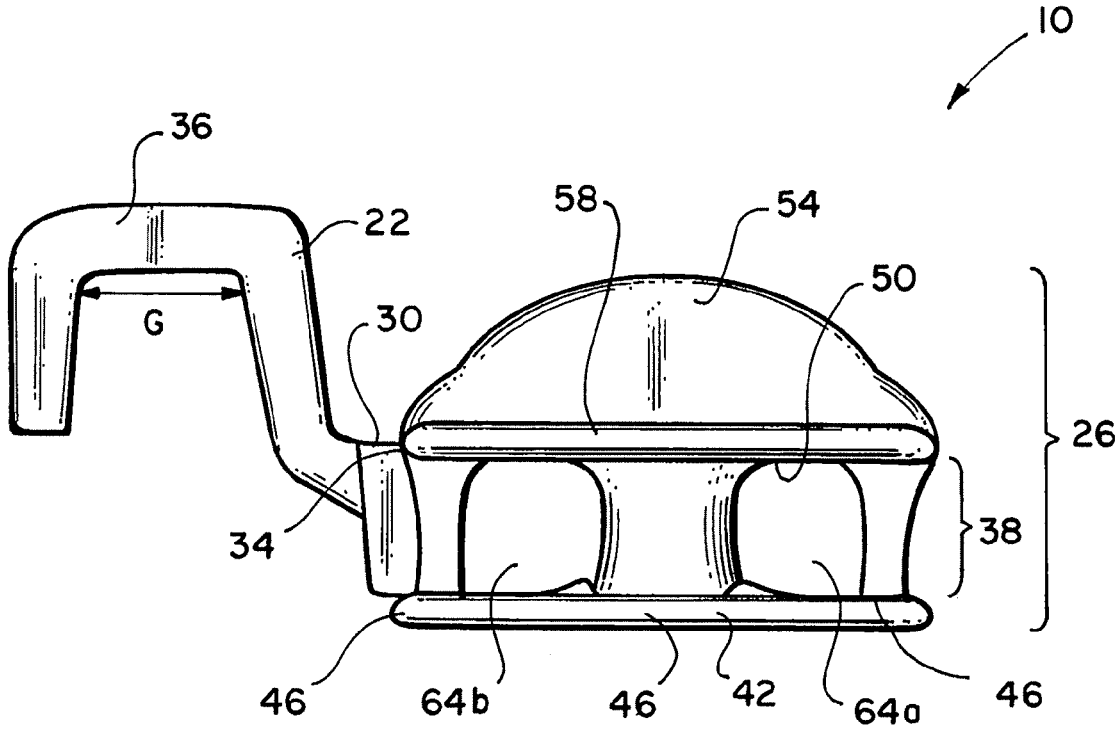
FIG. 1B is a front view of the bracing child bath seat.

FIG. 1A illustrates a child 6 sitting in a bracing child bath seat 10 that is secured to a rim 14 of a bathtub 18. Bath seat 10 includes a bracing structure 22 and a seat body 26 that holds child 6. As will be explained below, when attached to rim 14, bracing structure 12 secures seat body 14 firmly in place, thereby preventing child 6 from tipping bath seat 10 over during bathing or during the child's movements.

Referring to FIG. 11B, bracing structure 22 is molded at a proximal end 30 to a side 34 of seat body 26. A distal end 36 of bracing structure 22 is shaped to correspond to the shape of rim 14. Distal end 36 forms a gap, G, that accommodates the width of rim 14 so that when distal end 36 of bracing structure 22 is placed over the rim, the distal end wraps around the rim providing a snug fit between the bracing structure and the rim.

Seat body 26 includes a retaining barrier 38 and a seat 42, which is attached to the bottom surfaces 46 of retaining barrier 38, e.g., snapped or screwed together. Retaining barrier 38 includes a front restraint 50 and a back restraint 54 is attached using molded snaps (not shown) to front restraint 50. Front restraint 50 includes a smooth top surface 58 so that child 6 can rest their arms during bathing. Together seat 42, front restraint 50 and back restraint 54 form a cavity 62 in which child 6 is placed for bathing. In addition, front restraint 50 and seat 42 form two apertures 64*a* and 64*b*, each wide enough so that a leg of child 6 may pass through the aperture. Each component of bath seat 10 is fabricated from injection-molded plastic.

During typical bathing activity, an adult places distal end 36 of bracing structure 22 over rim 14 of bathtub 18. The adult guides the child through cavity 62 while simultaneously putting the child's legs through apertures 64*a* and 64*b*.

In this embodiment, a portion of the seat rests on the bottom surface of the bathtub. In other embodiments, however, the installed seat is suspended over the bottom of the bathtub.

Figure 2A:
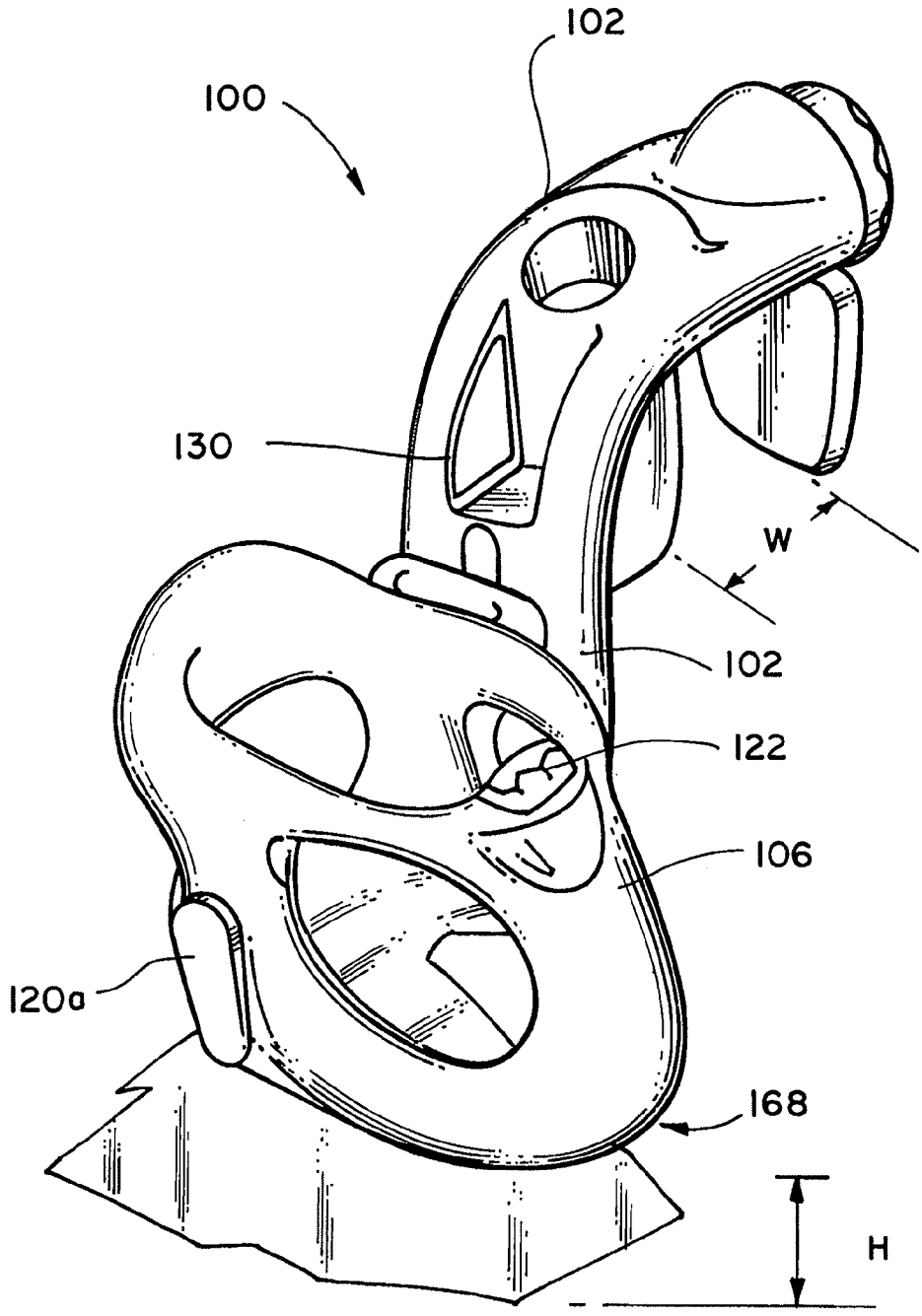
FIG. 2A shows another embodiment of a bracing child bath seat, with an adjustable bracing structure.
Figure 2B:
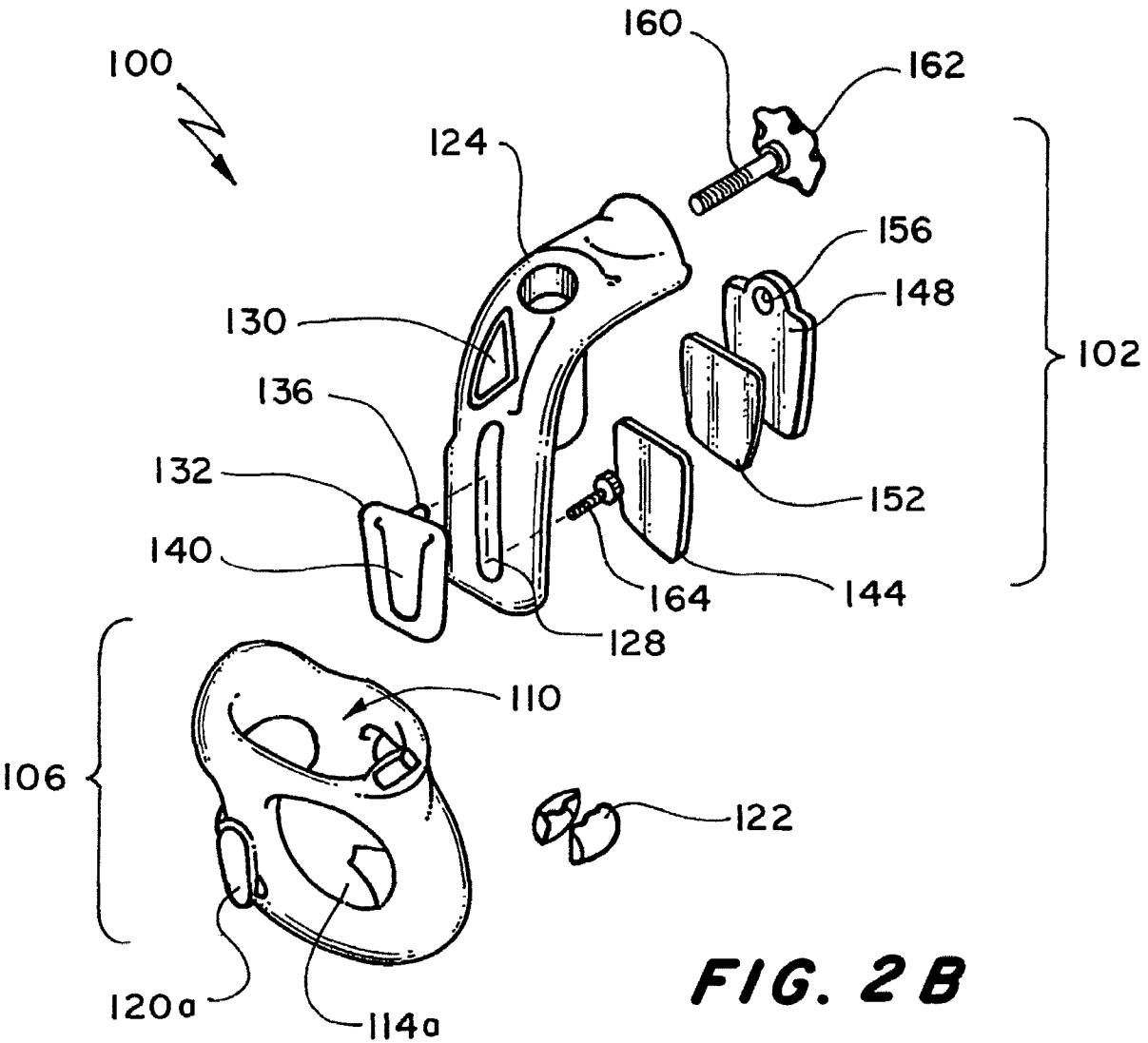
FIG. 2B is an exploded view of the embodiment in FIG. 2A.
Figure 3A:
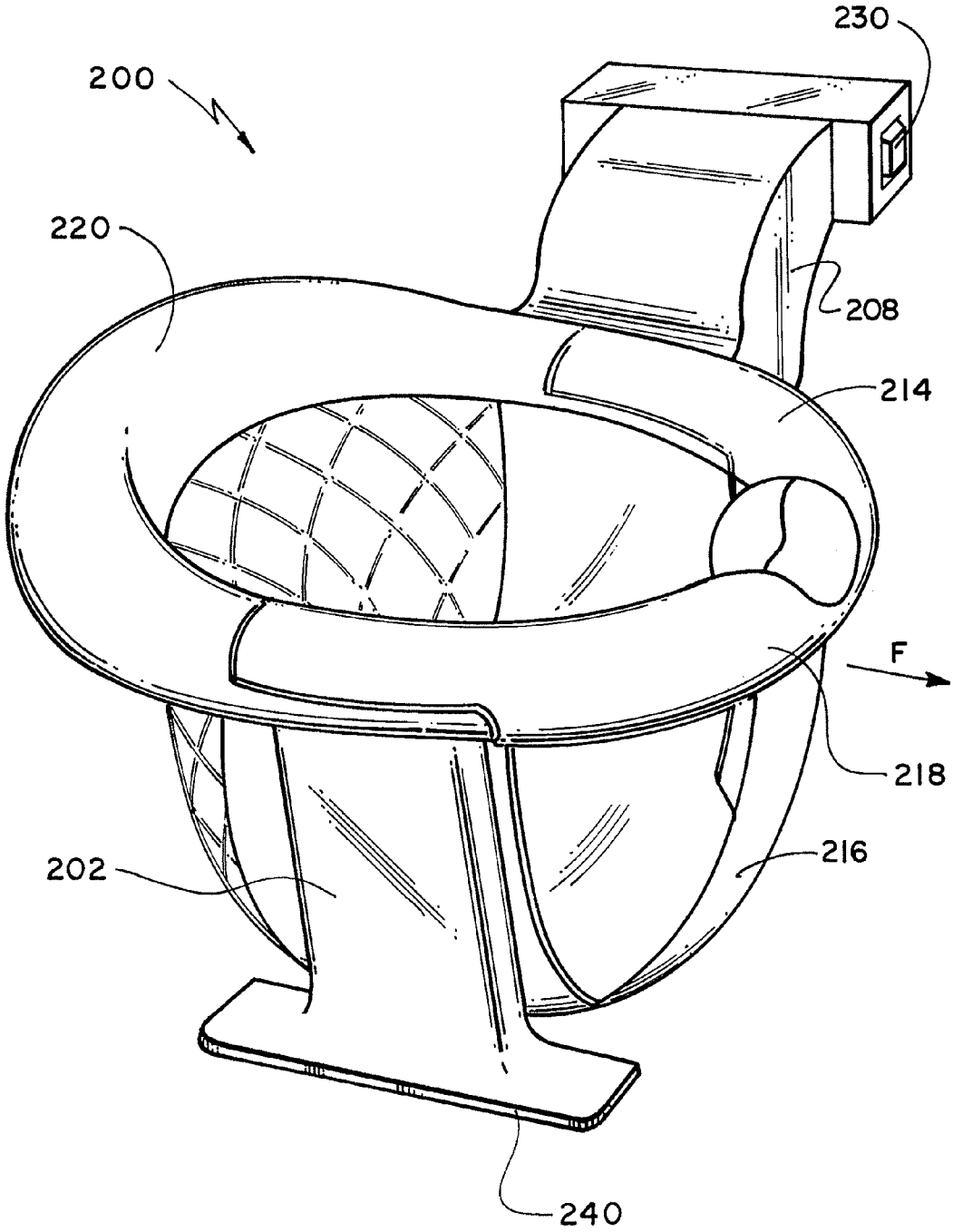
FIG. 3A shows another embodiment of a bracing child bath seat.
Figure 3B:
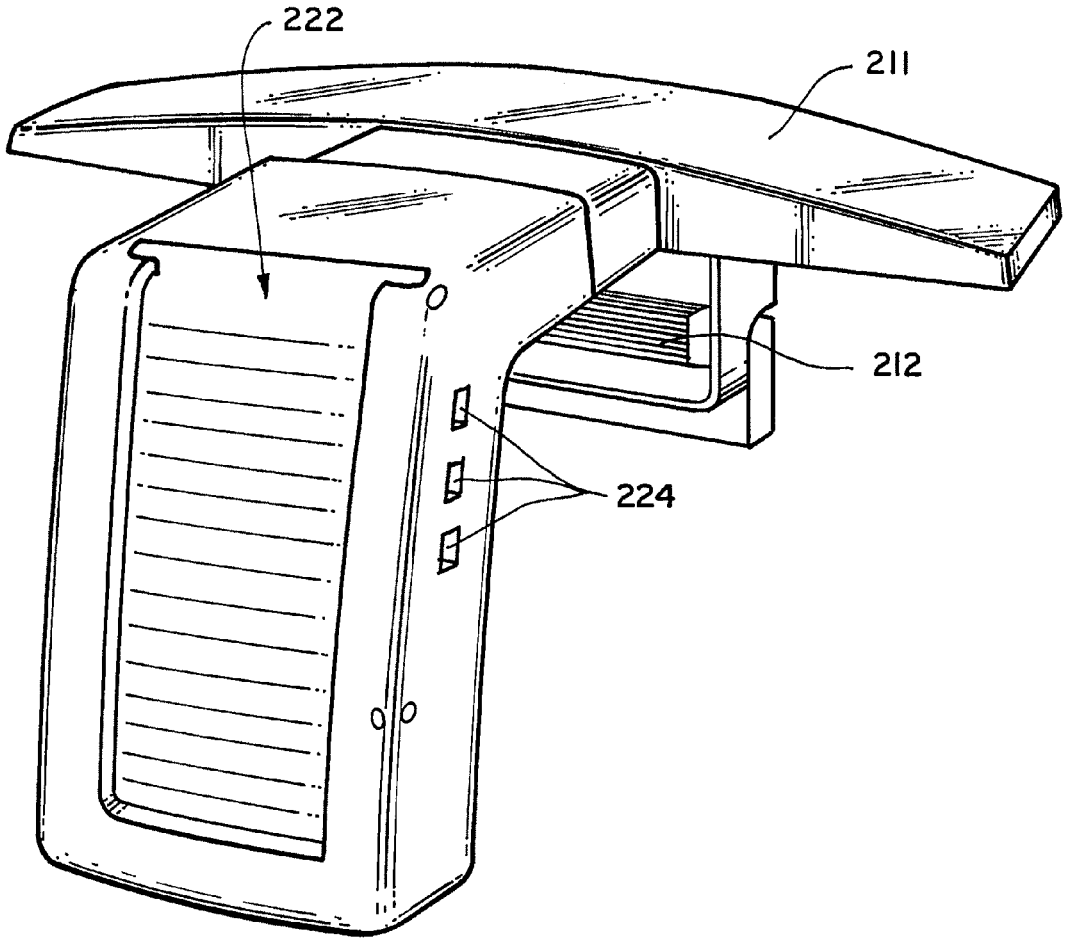
FIG. 3B is a perspective view of the clamp shown in FIG. 3A.
Figure 3C:
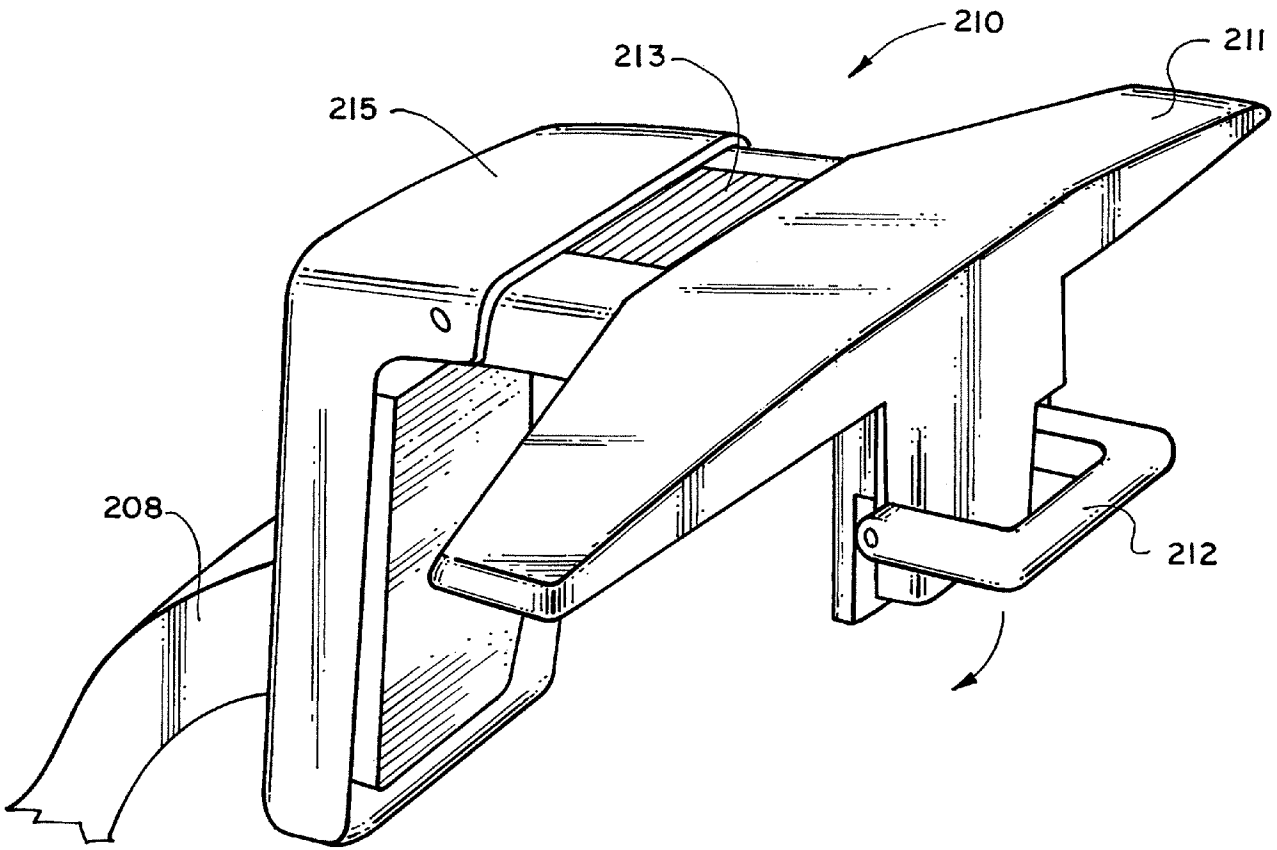
FIG. 3C is a perspective view of the clamp and shuttle shown in FIG. 3A.
Figure 3D:
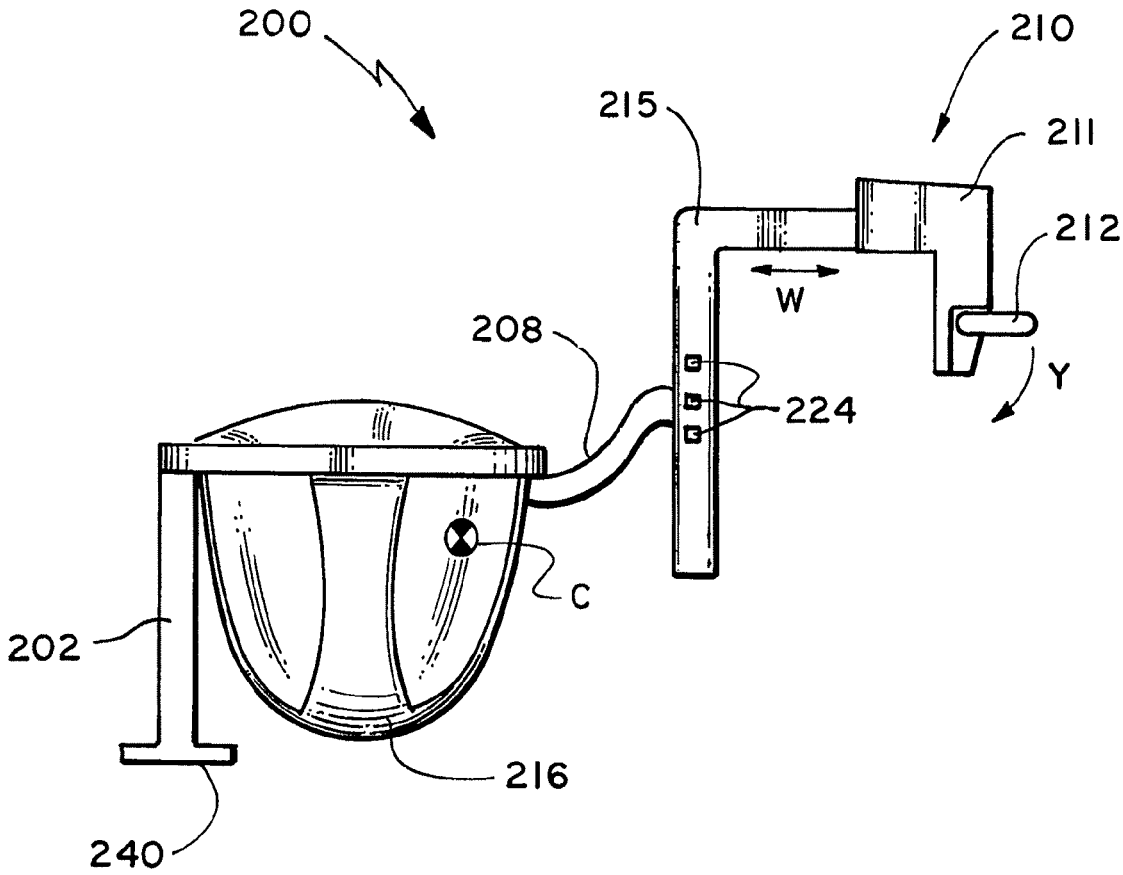
FIG. 3D is a front view of the embodiment of FIG. 3A.

Referring to FIGS. 2A and 2B, a second example of a bracing bath seat 100 includes an adjustable bracing structure 102 for bracing with non-standard width bathtub rims and for adjusting a height, H, of the bath seat relative to the bottom of the bathtub. Child bath seat 100 includes adjustable bracing structure 102 and a seat body 106. Seat body 106 includes a cavity 110 to receive child 6 and two openings 114*a* and 114*b*, each for receiving a leg of child 6. Seat body 106 also includes two flanges 120*a* and 120*b* located on opposite sides of seat body 106. Seat body 106 includes a toy rattle 122 for entertaining and distracting the child during bathing.

Adjustable bracing structure 102 includes a clamp housing 124 defining a channel 128 and a recess 130, a shuttle 132 having a dowel 136 and a slot 140, an inner pad 144, and a clamp plate 148 having an outer pad 152 and an aperture 156. Adjustable bracing structure 102 also includes adjustment screw threads (not shown) for receiving an adjustment screw 160 having a handle 162. Bath seat 110 is installed by placing dowel 136 of shuttle 132 into channel 128. As will be discussed below, the location where dowel 136 is placed along channel 128 determines a height, H, of bath seat 100 relative to a bottom 168 of the bathtub. Dowel 132 includes locking screw threads (not shown) for receiving a locking screw 164. Locking screw 164 is inserted through channel 128 and is received by the locking screw threads. Locking screw 164 is subsequently tightened to lock shuttle 132 to clamp housing 124.

Adjustable bracing structure 102 is secured to bathtub 18 by placing the inner pad 144 on the inside of the bathtub rim and clamp plate 148 on the outside of the bathtub rim with outer pad 152 in contact with the outer rim. Adjustment screw 160 is inserted through aperture 156 and is received by the adjustment screw threads. As adjustment screw 160 is tightened, clamp plate 148 moves closer to inner pad 144, thus the distance, W, between inner pad 144 and outer pad 152 is reduced until W equals the width of the bathtub, preferably until a sufficient clamp force develops between the bracing structure and the bathtub rim to secure the bath seat against movement during bathing.

Once adjustable bracing structure 102 is secured to bathtub 18, seat body 106 is connected to the adjustable bracing structure by lifting the seat body and sliding one of the flanges 120*a* and 120*b* into slot 140. The height, H, between a bottom 168 of bath seat 100 and the bottom of the bathtub, can be adjusted by moving shuttle 132 up or down along channel 128. By having flanges 120*a* and 120*b*, on each side, bath seat 100 can be mounted on each side.

Since bracing structure 102 is clamped tightly on the bathtub rim, bath seat 100 will be held securely in place.

Clamp housing 124 and seat 106 components are fabricated using blow-molding techniques. Shuttle 132, clamp plate 148, and handle 162 components are fabricated using injection molding.

Recess 130 is used to store soap, sponges or shampoo. In other embodiments, other recesses may be added to bath seat 100 and used to store other bathing items.

In a third example of a bracing bath seat 200, as shown in FIGS. 3A-3D, the bath seat is partially stabilized by a leg 202 that contacts the bottom surface of the bathtub. Bath seat 200 includes an adjustable bracing structure 204, attached to an adjustable rail 214, and a seat sling 216, attached to the bottom of the adjustable rail.

Adjustable bracing structure 240 includes a shuttle 208 that is detachably connected to a clamp assembly 210. Clamp assembly 210 includes a front piece 211 having an adjustable track 213 and a back piece 215. Shuttle 208 is engaged to clamp 210 by sliding the shuttle along a channel 222 on back piece 215. A spring-loaded button 230 on shuttle 208 is depressed prior to inserting shuttle 208 into channel 222 and remains depressed as the shuttle moves along the channel until the button aligns with one of a set of buttonholes 224. Button 230 is released thereby locking shuttle 208 to clamp 210. Shuttle 208 is disengaged from clamp 210 by pressing button 230 and moving the shuttle out of channel 222. Thus, an adult can easily use the bathtub by pushing button 230 and removing the entire bath seat except for clamp 210.

Adjustable rail 214 includes a front portion 218 and a back portion 220 attached together using a molded in track. Front portion 218 can be moved in a direction, F, away from back portion 220 along the molded track to adjust to the child's size.

Support leg 202 extends from back portion 220 opposite shuttle 208. With bath seat 200 in an upright intended use position and resting on a horizontal surface, the bath seat contacts the horizontal surface only on one side of its center of gravity, C. Bath seat 200 is constructed to not remain in an upright, intended use position when resting on a horizontal support surface without placing shuttle 208 into clamp assembly 210. This is intended to help deter the adult from placing the child in bath seat 200 unless and until the bath seat is secured to the rim of the bathtub. Support leg 211 includes a rubber bottom surface 240 to prevent slipping on a wet surface.

Attachment and adjustment of clamp assembly 210 to the side of the bathtubs of varying widths is accomplished by sliding back piece 215 along adjustment track 213 of front piece 211. Adjustment track 213 allows incremental adjustment of clamp assembly 210 to the bathtub side. A center cam lock 212 is used for the final tightening of bath seat 200 to a tub outside wall by moving cam lock 212 in a Y direction.

Figure 4A:
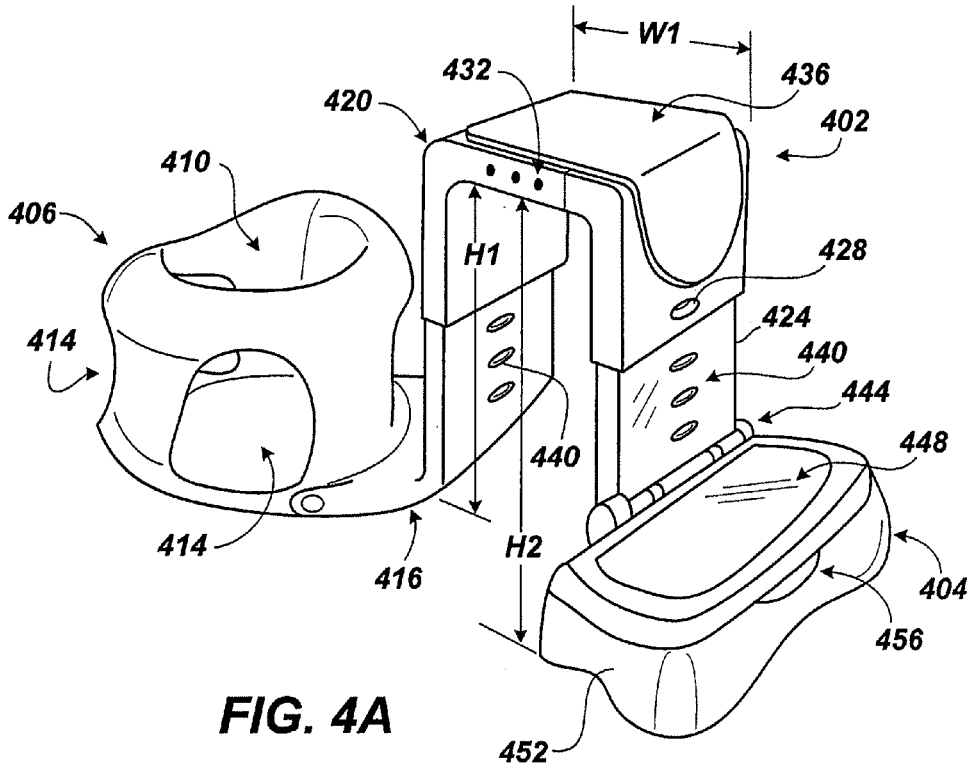
FIG. 4A is a perspective view of another embodiment of a bracing child bath seat with an attached foot structure.
Figure 4B:
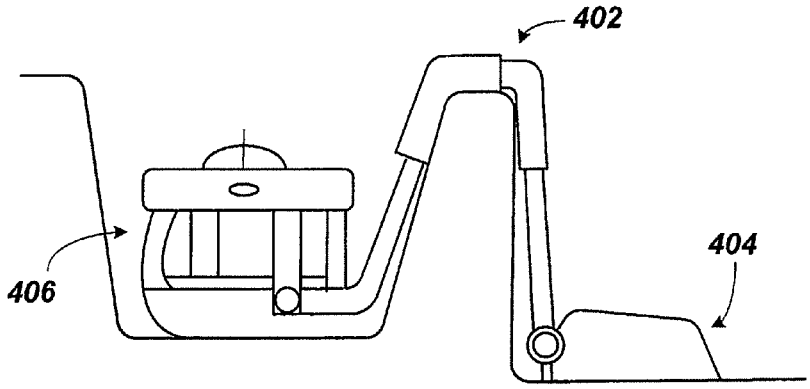
FIG. 4B is a side view of the embodiment in FIG. 4A.

Referring to FIGS. 4A and 4B, another example of a bracing bath seat 400 includes adjustable bracing structure 402, foot structure 404, and a seat body 406. Adjustable bracing structure 402 is for bracing with non-standard width bathtub rims and for adjusting a first height, H1, measured from a base of the bath seat, and a second height, H2, measured from a base of the foot structure 404. Seat body 406 includes a cavity 410 to receive a child and two openings 414, each for receiving a leg of the child. Seat body 406 is pivotally attached to a first end 416 of adjustable bracing structure 402.

Adjustable bracing structure 402 includes first end 416, a U-shaped receiving structure 420, and second end 424. The first end 416 and the second end 424 are inserted into the U-shaped receiving structure 420. The U-shaped receiving structure defines height adjustment openings 428 for selectively receiving spring-loaded height adjustment pins 440. Width adjustment openings 432 selectively receive a spring-loaded width adjustment pin (not shown). The U-shaped receiving structure 420 also includes foam comfort pads 436 on its upper surface for an adult to lean on while bathing a child in the bath seat 400. The second end 424 also includes a dowel and slots 444 arranged to pivotably attach foot structure 404 to the second end 424.

Foot structure 404 includes a first portion 448 with a padded upper surface. Foot structure 404 also includes walls 452 and a bottom (not shown) forming a bin 456 that defines a cavity (not shown). This bin can be used to store items such as toys or shampoo typically used in bathing a child. The first portion 448 and the bin 456 bin are independently pivotably attached to the bracing structure 402 and the first portion 448 is arranged to rest upon the bin 456 so as to cover the cavity (not shown) when the first portion 448 and the bin 456 are both pivoted away from the bracing structure 402.

Those skilled in the art will recognize that the foot structure can be implemented differently in various other embodiments. For example, the foot structure can comprise a piece of flexible material (not shown) extending from the bracing structure to drape across a predominantly horizontal surface, such as the floor, outside the bathtub.

An adult user installs bath seat 400 in a tub by depressing spring-loaded width adjusting pin 432, adjusting the U-shaped receiving structure 420 so that width W1 approximates the width of the edge of the tub where the bath seat 400 is being installed, and releasing the width adjusting pin (not shown) so that it engages one of the width adjusting openings 432. The adult user then places bath seat 400 so that U-shaped receiving structure 420 is resting on the edge of the tub with seat body 406 inside the tub and foot structure 404 outside of the tub. After verifying that W1 matches the dimensions of the edge of the tub as closely as possible, the adult user adjusts height, H1, so that seat body 406 rests firmly on the bottom surface of the tub, or at least within a few inches of the bottom of the tub, if the seat body is not pivotally attached to the bracing structure. Stability of the positioning of the seat body is provided by the bracing structure, alone or in combination with the bottom of the seat body resting on the bottom tub surface.

This stability is further enhanced by the various embodiments of foot structure 404. After the steps described above, the adult user deploys foot structure 404. With respect to a pivoting foot structure 404 as shown in FIGS. 4A and 4B, the adult user deploys the foot structure 404 by adjusting height H2 using height adjustment openings 428 and height adjustment pins 440. Foot structure 404 can be pivoted to a down position (as shown) before the height adjustment is performed. Furthermore, other means, such as releasable latches or clamps, may be implemented between second end 424 and receiving structure 420 in order to secure the two pieces together at any relative position, rather than at discrete points. For a foot structure comprising a piece of flexible material, such as a mat, extendable from the bracing structure to the predominantly horizontal surface outside the bathtub, the adult user deploys the foot structure by unrolling or extending the piece of flexible material from the bracing structure to the floor surface outside the bathtub. The flexible material foot structure has the advantage of not requiring a relative height adjustment with respect to the receiving structure.

The adult user then kneels on the foot structure while placing a child in the bath seat 400 and subsequently bathing the child. The adult user places the child in the bath seat 400 by placing the child in the cavity 410 of the seat body 406, inserting the legs of the child through openings 414. The foot structure 404 increases the stability of the bath seat 400, particularly when an adult user kneels on the foot structure. This takes advantage of the posture typically used by adults bathing children using a bath seat in a tub. Moreover, this increases the comfort of the adult user by providing a padded, elevated surface for the adult user to kneel on.

A number of embodiments of the invention have been described. Nevertheless, it will be understood that various modifications may be made without departing from the spirit and scope of the invention. For example, the seat body 406 can also comprise securing devices such as suction cups to enhance the stability of the bath seat. Accordingly, other embodiments are within the scope of the following claims.

What is claimed is:

1. A bath seat adapted for use with a bathtub, the bath seat comprising:

a receptacle adapted to receive a child, the receptacle including a flange on an outside surface of the receptacle;

a shuttle including a recess adapted to receive and engage the flange, the shuttle including a fastener; and a housing adapted to be secured to a wall of the bathtub, the housing including a recess adapted to receive the fastener of the shuttle, the fastener operable to slide vertically within the recess and adjust a height of the shuttle and the receptacle with respect to a bottom surface of the bathtub.

2. The bath seat of claim 1, wherein the housing further includes a block having a first surface adapted to contact an inside surface of the wall of the bathtub.

3. The bath seat of claim 2, wherein the housing further includes a bracket coupled to the housing and adapted to contact an outside surface of the wall of the bathtub, the bracket being movable to accommodate the width of the wall.

4. The bath seat of claim 1, wherein the receptacle includes a seat and a retaining structure extending above the seat for laterally retaining a child seated in the receptacle.

5. The bath seat of claim 4, wherein the seat is supported by the bottom surface of the bathtub.

6. The bath seat of claim 4, wherein the seat is suspended from the housing.

7. The bath seat of claim 4, wherein the retaining structure includes a plurality of openings adapted to receive the legs of the child.

8. The bath seat of claim 4, further comprising a leg coupled to the retaining structure and adapted to contact the bottom surface of the bathtub to support the receptacle.

9. The bath seat of claim 4, further comprising a leg coupled to the seat and adapted to contact the bottom surface of the bathtub to support the receptacle.

10. The bath seat of claim 1, further comprising a second flange on an opposite side of the receptacle as the first flange.

11. The bath seat of claim 1, wherein the receptacle includes a rim and a sling extending from the rim.

12. The bath seat of claim 11, wherein the rim is adjustable to adjust a size of the receptacle.

13. A bath seat adapted for use with a bathtub, the bath seat comprising:

a seat adapted to receive a child, the seat including a base and a wall substantially surrounding the base, the wall including a plurality of openings, at least two of the openings adapted to receive a leg of the child a flange integrally formed on an outside surface of the wall of the seat;

a shuttle including a recess adapted to receive and engage the flange, the shuttle including a fastener; and a housing adapted to be secured to a wall of the bathtub, the housing including a recess adapted to receive the fastener of the shuttle, the fastener operable to slide vertically within the recess and adjust a height of the shuttle and the receptacle with respect to a bottom surface of the bathtub.

14. The bath seat of claim 13, further comprising a second flange on an opposite side of the wall as the first flange.

15. The bath seat of claim 13, wherein the housing further includes a block having a first surface adapted to contact an inside surface of the wall of the bathtub.

16. The bath seat of claim 15, wherein the housing further includes a bracket coupled to the housing and adapted to contact an outside surface of the wall of the bathtub, the bracket being movable to accommodate the width of the wall.

17. The bath seat of claim 13, wherein the base of the seat is supported on the bottom surface of the bathtub.

* * * * *